US005762331A

United States Patent [19]

Kusch et al.

[11] Patent Number: 5,762,331

[45] Date of Patent: Jun. 9, 1998

[54] FORMAT-VARIABLE FEEDBOARD

[75] Inventors: Hans-Jürgen Kusch, Neckargemünd; Kurt Lötsch, Wiesenbach; Bernd Ruf, Weiterstadt, all of Germany

[73] Assignee: Heidelberger Druckmaschinen AG, Heidelberg, Germany

[21] Appl. No.: 541,917

[22] Filed: Oct. 10, 1995

[30] Foreign Application Priority Data

Oct. 8, 1994 [DE] Germany ..... 44 35 989.6

[51] Int. Cl.[6] ..... B65H 1/00

[52] U.S. Cl. ..... 271/171

[58] Field of Search ..... 271/171; 414/900, 414/923; 101/232, 240

[56] References Cited

U.S. PATENT DOCUMENTS

| | | | |
|---|---|---|---|
| 3,355,167 | 11/1967 | Reeves . | |
| 3,527,459 | 9/1970 | Zeman . | |
| 5,121,169 | 6/1992 | Kawabata | 271/171 X |

FOREIGN PATENT DOCUMENTS

| | | | |
|---|---|---|---|
| 0 601 734 A1 | 6/1994 | European Pat. Off. . | |
| 75 38717 | 7/1977 | France . | |
| 1152708 | 8/1963 | Germany | 271/171 |
| 6-20765 | 6/1994 | Japan . | |

OTHER PUBLICATIONS

"Adjustable Tray", Research Disclosure No. 18184, dated May 1979, p. 236.

"Sheet Hopper for a Sheet Handling Apparatus", Research Disclosure No. 23825, dated Feb. 1984, pp. 57–61.

*Primary Examiner*—David H. Bollinger

*Attorney, Agent, or Firm*—Herbert L. Lerner; Laurence A. Greenberg

[57] ABSTRACT

A format-variable feedboard with a sheet-bearing surface for a rotary printing press includes support members disposed so as to form a format-dependent, substantially closed bearing surface for at least one sheet, the substantially closed bearing surface being disposed in a given bearing plane.

9 Claims, 4 Drawing Sheets

FORMAT-VARIABLE FEEDBOARD

BACKGROUND OF THE INVENTION

FIELD OF THE INVENTION

The invention relates to a format-variable feedboard for sheets in rotary printing presses.

It has become well known heretofore that pile bins which are matched to respective formats of paper sheets to be processed are used for the sheet pile on a feedboard. When a change of format is to occur, the respective pile bins must be replaced by others having the correspondingly different format.

Japanese Utility Model Hei 6-20765 discloses a format-adjustable pile bin having a base member formed with recesses, both in side edges thereof wherein lateral guides run and at a front or leading edge thereof, which do not prevent displacement of adjustable front or leading-edge guides.

In the device according to the aforementioned Japanese utility model, it is disadvantageous that the recesses in the side edge are not closable, and that the devices for closing the recesses at the front or leading edge are not disposed in the same plane as the bearing or support surface of the pile bin. Accordingly, the sheets to be processed do not rest uniformly on the pile bin overall. Particularly when thin paper, such as paper for printing Bibles, for example, is being processed, this can result in undesired creasing or wrinkling, which has a negative effect upon the feed register.

SUMMARY OF THE INVENTION

It is accordingly an object of the invention to provide a form-variable feedboard for a rotary printing press which avoids the foregoing disadvantages of heretofore known devices of this general type.

With the foregoing and other objects in view, there is provided, in accordance with the invention, a format-variable feedboard with a sheet-bearing surface for a rotary printing press, comprising support members disposed so as to form a format-dependent, substantially closed bearing surface for at least one sheet, the substantially closed bearing surface being disposed in a given bearing plane.

In accordance with another feature of the invention, the support members are mounted so as to be displaceable in and opposite to a sheet transport direction.

In accordance with a further feature of the invention, the support members are disposed so as to be lowerable to a location below the given bearing plane.

In accordance with an added feature of the invention, the support members are disposed adjacent and parallel to one another.

In accordance with an additional feature of the invention, the support members, respectively, have an entrainer pin and an entrainer guide, respective entrainer pins of the support members being engageable in respective entrainer guides of the support members adjacent thereto.

In accordance with yet another feature of the invention, the support members, respectively, have a guide formed as an incline on an underside of the support members facing away from the bearing surface thereof.

In accordance with yet a further feature of the invention, the feedboard includes board boxes wherein the support members are disposed, the guide inclines, respectively, of the support members being disposed so as to be bringable into sliding contact with corresponding inclines formed on the board boxes.

In accordance with yet an added feature of the invention, the support members, respectively, are formed with a recess for actuating the respective support members.

In accordance with yet an additional feature of the invention, the support members are formed as bars or beams.

In accordance with another feature of the invention, the support members and the board boxes are formed with a respective setback and projection which are bringable into mutual contact so that the support members, in an end position thereof, are secured against displacement.

In accordance with a concomitant feature of the invention, the support members are movable from a retracted position thereof into an extended position thereof, and including a respective bracing strip for the support members whereon the support members rest in the extended position.

An advantage of the feedboard according to the invention is that the sheet-bearing or support plates no longer need to be changed when a change of format is to be performed.

Another advantage is that a support or bin can be prepared for the sheets to be processed which supports even a large-format pile of sheets uniformly at substantially all locations thereof.

The support device provided for that purpose is particularly easy to use and is disposed so as to be adjustable either by hand or by means of a tool. The support members of the support device are displaceable in and opposite to the sheet transport direction and, together with a remainder of the feedboard they form a bearing or support surface which is disposed in a given single plane.

In another user-friendly feature, the support device has an entrainer device which permits rapid adjustment.

In another favorable feature of the invention, the nonrequired support members are lowerable entirely beneath the bearing plane.

Detent means are provided for securing the support device in an end or final position thereof.

Other features which are considered as characteristic for the invention are set forth in the appended claims.

Although the invention is illustrated and described herein as embodied in a format-variable feedboard, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which:

DESCRIPTION OF THE PREFERRED EMBODIMENTS

Figure 1:
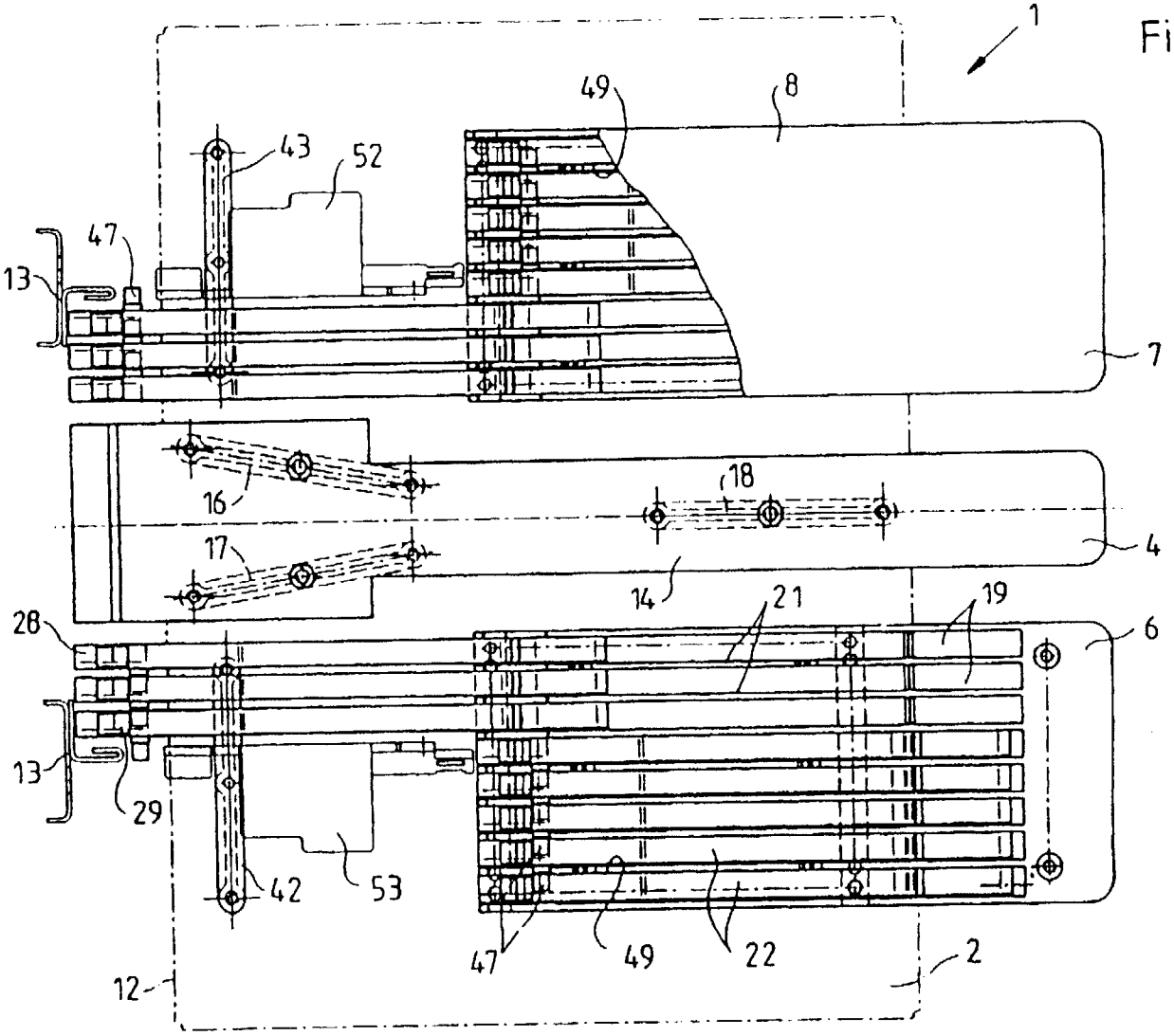
FIG. 1 is a diagrammatic top plan view of a sheet-pile bin according to the invention.
Figure 2:
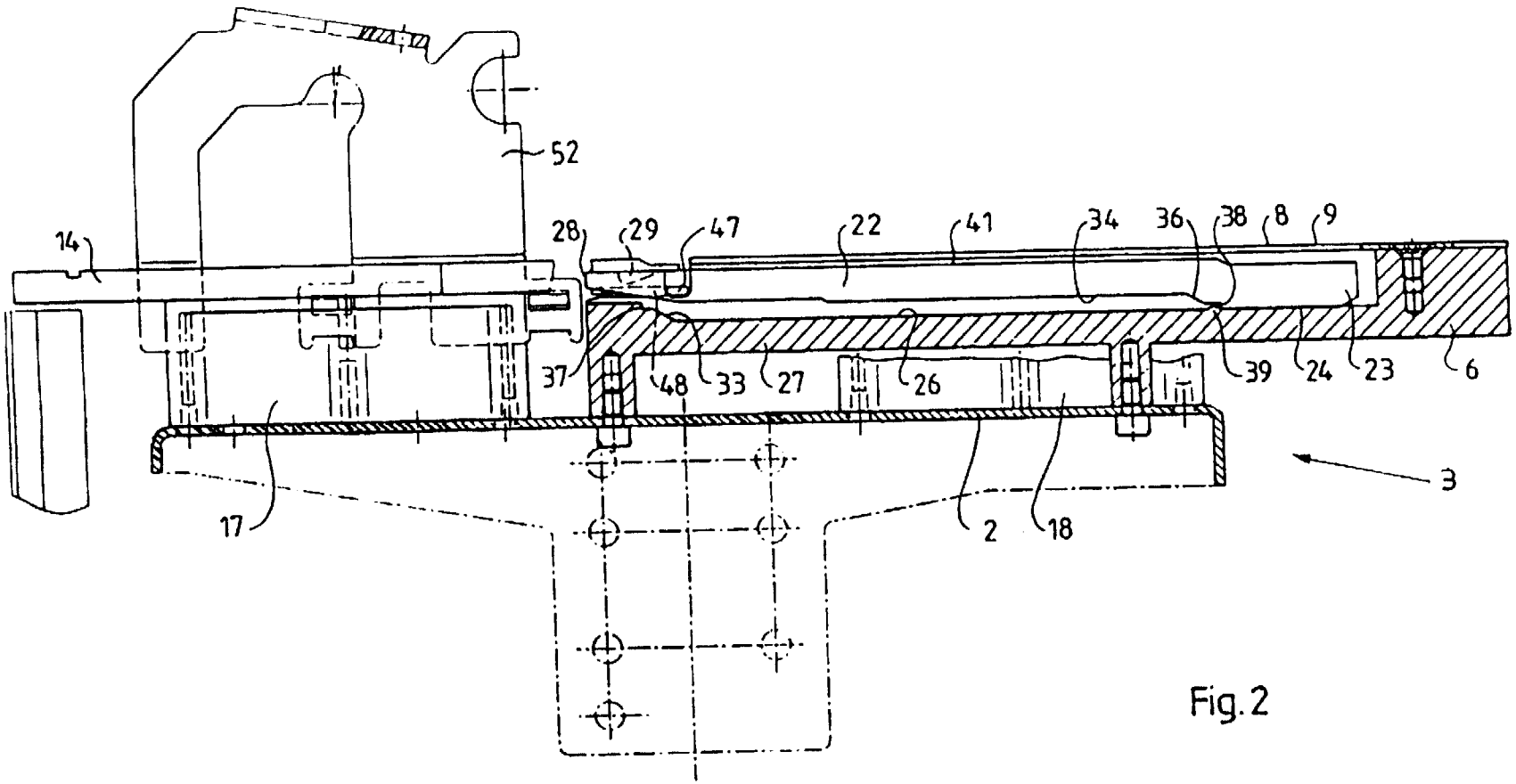
FIG. 2 is a diagrammatic vertical sectional view of a feedboard supporting the sheet-pile bin according to the invention.
Figure 3:
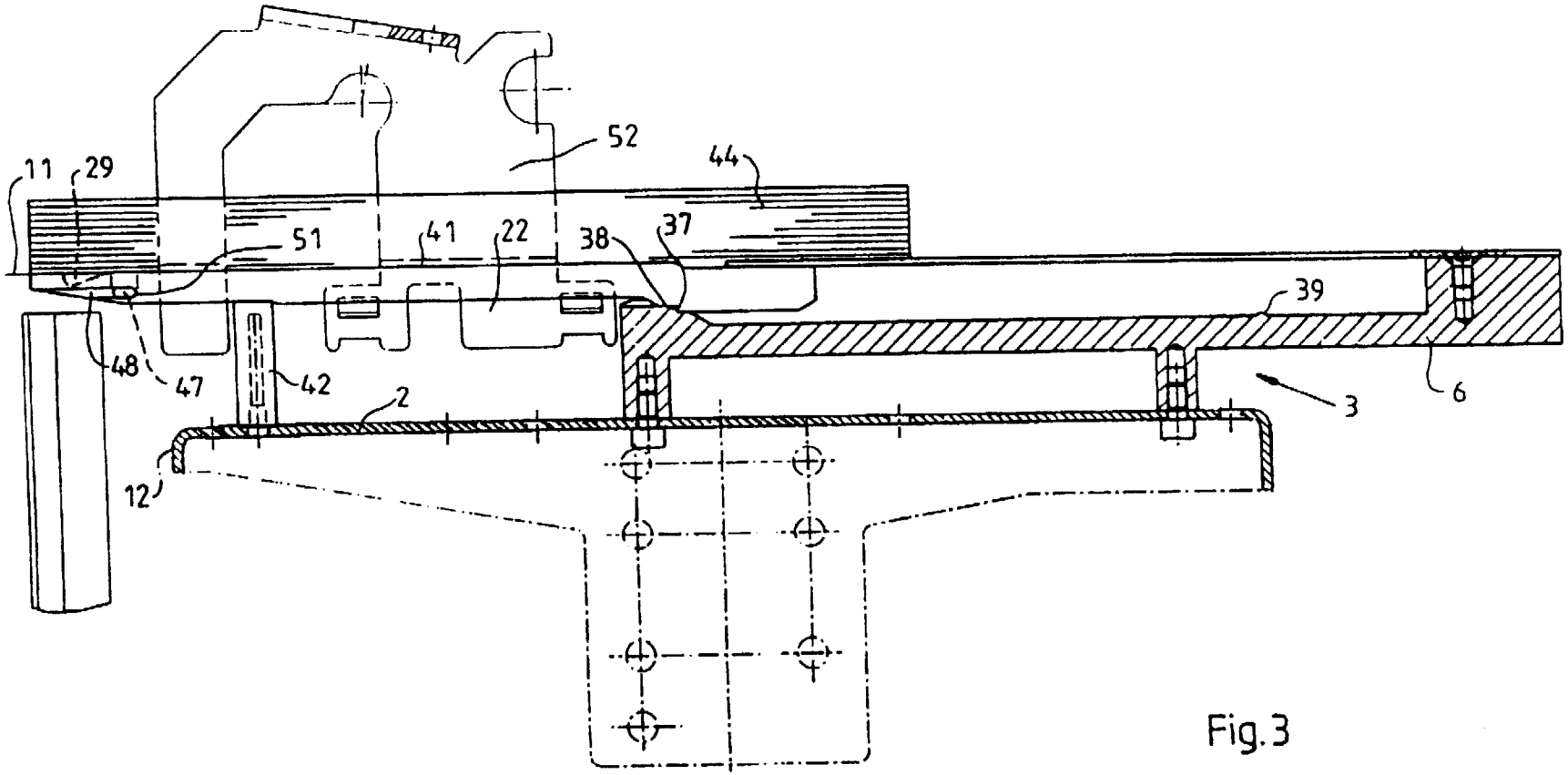
FIG. 3 is a view like that of FIG. 2 of the feedboard in another operating phase thereof wherein supporting elements thereof are extended.
Figure 4C:
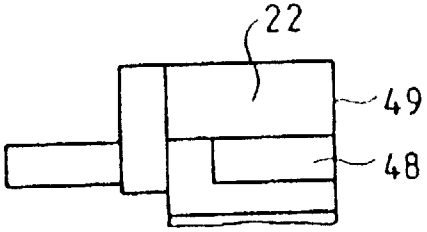
FIGS. 4*b* and 4*c* are respective top plan and front elevational views of FIG. 4*a*.
Figure 4B:
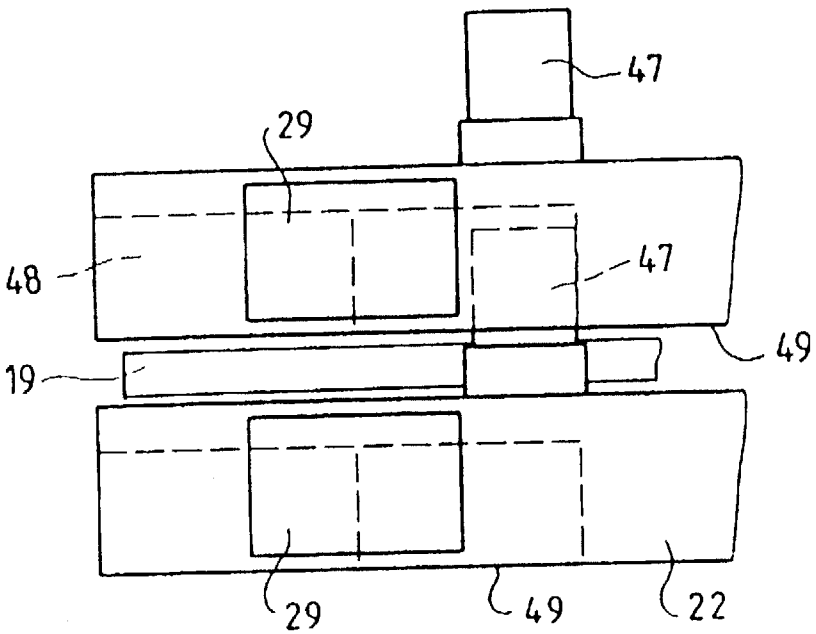
Figure 4A:
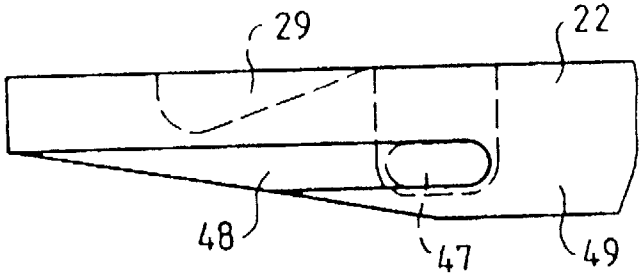
FIG. 4*a* is an enlarged fragmentary view of FIG. 3 showing a tip of one of the support elements.

Referring now to the drawings and, first, particularly to FIGS. 1 and 2 thereof, there is shown therein a feedboard 1 having a base plate 2 wherein a support or bin 3 for a pile of sheets is secured. The sheet bin 3 is formed of a middle board 4 and, to the left-hand and right-hand sides thereof, as viewed in the sheet transport direction in FIG. 1, board boxes or cases 6 and 7. Each of the board boxes 6 and 7 are covered by a pile support or bearing plate 8, having an upper side 9, as shown in FIG. 2, which forms a pile-bearing or support plane 11. The boxes 6 and 7 disposed in a rear region, i.e., to the right-hand side of FIG. 1, for example, are covered virtually entirely by the sheet-pile bearing or support plate 8. The middle board 4 extends to above a front or leading edge 12 of the base plate 2, and into the immediate vicinity of front or leading-edge guides 13. These guides 13 are adjustable transversely to the sheet transport direction, i.e., from the right-hand towards the left-hand sides of FIGS. 1 and 2, and are preferably displaceable on a crossbar or traverse. The middle board 4 includes a plate 14 which is secured on the base plate 2 by means of bracing strips 16, 17 and 18. The two boxes 6 and 7 are identical in construction and, in the interest of facilitating a more ready comprehension of the invention, they will be described below in terms of the board box 6 solely.

The board box 6 has a number of chambers 19, which are separated from one another by side walls 21. Bar-like support members 22 (eight of them per box, for example) are disposed in the chambers 19 and are displaceable in the sheet transport direction and opposite thereto. The support members 22, respectively, have a slide bearing 24 at respective ends 23 thereof remote from the front or leading-edge guides 13, and the slide bearing 24 slides on an upper side 26 of a base 27 of the respective box 6. The support members 22 are identical to one another, and they will therefore be described only in terms of one support member 22. At an end 28 of the support member 22 opposite from the slide bearing 24, the support member 22 is formed with a recess 29. This recess 29 offers operators the possibility of access for actuating the support member 22 by means of a tool or by hand.

The support member 22, in a retracted condition as shown in FIG. 2, rests on the respective side wall 21 through the intermediary of an entrainer pin 47 disposed laterally thereon. In the front region of the support member 22, the box 6 is not covered by the pile-bearing or support plate 8, so that free access to the recesses 29 is assured. The base 27 of the board box 6 is formed with an incline 33 in a front region thereof facing towards the front or leading-edge guides 13. The incline 33 ends at a stop 37.

On an underside 34 at an end 23 of the support member 22, in the region thereof wherein the slide bearing 24 is provided, an incline 36 is formed, which may be brought into operating connection with the incline 33 when the support member 22 is slid out of the interior of the box 6. On the underside 34 of the support member 22, a setback 38 is provided between the incline 36 and the slide bearing 24. To secure the support member 22 against unintentionally slipping out, a protrusion or projection 39 is provided on the upper surface 26 of the box base 27. In the retracted condition, the support member 22 rests on this projection 39 at the setback 38.

When the support member 22 slides out of the box 6, the incline 36 of the support member 22 slides on the incline 33 of the box base 27 in a manner that the support member 22 is lifted out of the box 6 so far that an upper side 41 of the support member 22 is located in the same bearing or support plane 11 as that wherein the sheet-bearing or support plate 8 is disposed.

In an extended end position of the support member 22, the setback 38 rests on the stop 37. This prevents the support members 22 from being pulled all the way out of the box 6. In order to provide the respective support members 22 with a stable position, the front or leading ends thereof are placed on bracing strips 42 and 43.

So that an operator will not to have to pull the support members 22 individually out of the box 6, depending upon the format width of a pile 46 of sheets to be processed, an entrainer device is provided so that only the respective outermost support member 22 need to be pulled out. The support members 22 disposed farther inwardly are entrained by the respective support member 22 adjacent thereto. To that the support members 22 disposed on the inside between the outer support members 22 therefore have an outwardly-directed entrainer pin 47 which engages in a slot or elongated groove 48 formed in the side 49 of the respective adjacent support member 22, the groove being open as viewed in the direction towards the front or leading end 28 of the support member 22. Only the respective support members 22 located entirely on the outside are formed with the slot or elongated groove 48 disposed on the inwardly-directed sides 49 thereof. Only the support members 22 located entirely on the inside have the entrainer pin 47 disposed on the outwardly-directed side thereof.

Should a bearing or support surface then be required to be made ready for a format wherein it is necessary, for example, to pull three support members 22 out of the box 6, the operator then reaches into the recess 29 of the respective third support member from the inside and pulls it all the way out. Entraining contact then occurs between the entrainer pin 47 of the second support member 22, by way of one end 51 of the slot or elongated groove 48 of the third support member 22 and, simultaneously, an entraining contact occurs between the entrainer pin 47 of the first support member 22 and one end 51 of the slot or elongated groove 48 of the second support member 22. The entrainer pin 47 of the third support member 22 slides out of the slot or elongated groove 48 of the fourth support member through the open front end of the respective slot 48.

Due to the foregoing measures, a bearing or support surface for a pile of sheets 44 is made ready which is formed of three support members 22 and a middle board 4. Lateral guides 52 and 53 which are movable transversely to the sheet transport direction can then be brought right up to the sheet pile 44.

If the bearing or support surface face is made smaller, for example, for a minimum format, the operator then need merely insert the first support member 22 into the box 6. The entrainer pin 47 of the first support member 22 then entrains the second support member 22, and the entrainer pin 47 of the second support member 22 entrains the third support member 22.

We claim:

1. A format-variable feedboard with a sheet-bearing surface for a rotary printing press, comprising a plurality of support members commonly defining a format-dependent, substantially closed bearing surface for at least one sheet, said substantially closed bearing surface being disposed in a given bearing plane, said support members being displaceably in and opposite to a sheet transport direction, and said support members being disposed so as to be lowerable to a location below said given bearing plane.

2. Feedboard according to claim 1, wherein said support members are disposed adjacent and parallel to one another.

3. Feedboard according to claim 2, wherein each of said support members includes an entrainer pin and an entrainer guide, and wherein a respective entrainer pin of one of said support members is engageable in a respective entrainer guide of the support member adjacent thereto.

4. Feedboard according to claim 2, wherein each of said support members has an inclined guide formed on an underside thereof facing away from said bearing surface thereof.

5. Feedboard according to claim 4, including board boxes wherein said support members are disposed, and wherein said guide inclines, respectively, of said support members are disposed so as to be bringable into sliding contact with corresponding inclines formed on said board boxes.

6. Feedboard according to claim 5, wherein said support members and said board boxes are formed with a respective setback and projection which are bringable into mutual contact so that said support members, in an end position thereof, are secured against displacement.

7. Feedboard according to claim 1, wherein said support members, respectively, are formed with a recess for manually shifting the respective support members.

8. Feedboard according to claim 1, wherein said support members are formed as bars or beams.

9. Feedboard according to claim 1, wherein said support members are movable from a retracted position thereof into an extended position thereof, and including a respective bracing strip for said support members whereon said support members rest in said extended position.

* * * * *